US008444042B2

(12) United States Patent
Nakamura et al.

(10) Patent No.: US 8,444,042 B2
(45) Date of Patent: May 21, 2013

(54) METHOD FOR PRODUCING STEEL PIPE PLATED WITH METAL BY THERMAL SPRAYING

(75) Inventors: Shinichiro Nakamura, Tokyo (JP); Tadayoshi Tamamura, Tokyo (JP)

(73) Assignee: Daiwa Steel Tube Industries Co., Ltd., Tokyo (JP)

( * ) Notice: Subject to any disclaimer, the term of this patent is extended or adjusted under 35 U.S.C. 154(b) by 0 days.

(21) Appl. No.: 13/408,768

(22) Filed: Feb. 29, 2012

(65) Prior Publication Data

US 2012/0160901 A1 Jun. 28, 2012

Related U.S. Application Data

(62) Division of application No. 11/791,052, filed as application No. PCT/JP2004/017202 on Nov. 18, 2004, now abandoned.

(51) Int. Cl.

| | |
|---|---|
| ***B21C 37/08*** | (2006.01) |
| ***B23K 33/04*** | (2006.01) |
| ***B23K 20/24*** | (2006.01) |

(52) U.S. Cl.
USPC ..... 228/150; 228/166; 228/203

(58) Field of Classification Search
USPC ..... 427/404–406, 454–456; 29/527.2, 29/527.4
See application file for complete search history.

(56) References Cited

U.S. PATENT DOCUMENTS

| | | | | |
|---|---|---|---|---|
| 3,559,280 | A * | 2/1971 | Mailhiot | 29/527.4 |
| 3,827,139 | A | 8/1974 | Norteman | |
| 5,732,874 | A * | 3/1998 | Borzym et al. | 228/147 |

FOREIGN PATENT DOCUMENTS

| | | |
|---|---|---|
| EP | 1287934 | 3/2003 |
| GB | 1473957 | 5/1977 |
| JP | 61-157669 | 7/1986 |
| JP | 5-148607 | 6/1993 |
| JP | 6335611 | 12/1994 |
| JP | 7-145489 | 6/1995 |
| JP | 07-292482 | 11/1995 |
| JP | 10-53856 | 2/1998 |
| JP | 2001-276966 | 10/2001 |
| JP | 2002-225668 | 8/2002 |
| JP | 2003-34856 | 2/2003 |
| JP | 2004-066265 | 3/2004 |

* cited by examiner

*Primary Examiner* — Kiley Stoner
*Assistant Examiner* — Carlos Gamino
(74) *Attorney, Agent, or Firm* — Jordan and Hamburg LLP

(57) ABSTRACT

[Problems] To provide a process for producing a thermal sprayed, metal plated steel tube having a metal layer substantially uniform and favorable over the whole surface in a highly productive manner.

[Means for solving] A process for producing a metal tube comprising continuously forming a metal plate composed of a first component into a tubular shape and continuously welding its butted ends to form the metal tube, wherein, after the continuous welding, a metal layer composed of a second component which is different from the first component is formed by thermal spraying directly over the surface of the metal tube, the metal layer having no discontinuities in the circumferential and lengthwise directions. Especially it is preferred that the process comprises a process step of making the thickness distribution of the metal layer more uniform after formation of the thermal sprayed metal layer over the external surface.

14 Claims, 4 Drawing Sheets

METHOD FOR PRODUCING STEEL PIPE PLATED WITH METAL BY THERMAL SPRAYING

The present application is a divisional application of copending U.S. application Ser. No. 11/791,052, filed Jun. 27, 2007, which is the U.S. National Stage of International Application No. PCT/JP2004/017202, filed Nov. 18, 2004. The disclosures of these applications are incorporated herein by reference.

BACKGROUND OF THE INVENTION

The present invention relates to a process for producing a metal plated steel tube, comprising a thermal spraying step to the internal or external surface of the steel tube.

Traditionally, processes for producing metal plated steel tubes are known which comprise a step of continuously forming a steel plate that is plated on both sides with a heterogeneous metal (typically, zinc) into a tubular shape using roll forming, a step of continuously welding the tubular plated steel plate so formed at its end faces to form a tube, a step of continuously cutting weld beads that are formed on the external surface of the steel tube during the previous step and a step of thermal spraying portions where part of the plated layer has been removed due to the cutting with the same metal as the one for the plating or with a heterogeneous metal (Patent Reference 1).

In such steps, it is also contemplated that the final thermal spray coating of the unplated portions may be substituted with continuous molten plating (Japanese Patent Application No. 2002-225668 by the Applicant (unpublished)). Patent Reference 1: Japanese Unexamined Patent Publication No. 1993-148607.

In such a field of art, thermal spraying is exclusively used for repair applications. It means that the idea of thermal spraying metal tubes partially with a metal on their unplated portions in order to shield such portions and the like from the ambient atmosphere exists. Such an idea that, in order to modify a whole plated layer, thermal spraying a whole tube instead of specific portions thereof to form a metal layer all over the tube does not, however, exist.

On the other hand, for the purpose of modifying a whole plated layer instead of repairing, steps are known in which molten plating is also applied using a similar or dissimilar metal to the steel tube produced according to the steps for production described above. For example, it is known that by incorporating aluminum to zinc plating, corrosion resistance that may not be obtained with zinc alone may be realized. As environments where products are used become increasingly stringent year after year, with lengthening of high corrosion resistance and service life being desired, there is a need for new alloy plating. As such, characteristics required include wear resistance, heat resistance, electrical insulation, electromagnetic shielding and electrical conductivity, in addition to corrosion resistance, all of which may be realized by coating with other metallic and nonmetallic materials in a composite manner.

Conventionally, the step of coating with multiple heterogeneous metals involves forming a steel plate plated with zinc on both sides using roll forming and the like, followed by continuous welding and removal of beads and the like, before molten plating with zinc or a different metal (aluminum, for example). However, providing anew a molten plating bath along an existing line will present a difficulty in terms of process design and arrangement and initial investment will be substantial.

SUMMARY OF THE INVENTION

Metal plated steel tubes as produced by processes using continuous thermal spraying suffer from disadvantages as follows. Since bonding strength of thermal sprayed metal layers at the interface with the steel tubes is poorer in comparison with that of molten plated layers, when a processing such as bending is applied, the thermal sprayed metal layers will develop delamination and/or cracking, potentially causing problems in corrosion resistance of the steel tubes. Also, it is difficult to finely control the thickness of the thermal sprayed metal layers, making it difficult to form thermal sprayed metal layers in a uniform manner.

Proposed in the light of the above, the present invention has an object of providing a process for producing a thermal sprayed, metal plated steel tube having a substantially uniform and favorable metal layer over the whole surface in a highly productive manner. The present invention has another object of forming a metal layer having sufficient bonding strength with a metal layer of a plated layer.

In order to attain the objects described, a process for producing a thermal sprayed metal plating according to the present invention comprises a step of continuously thermal spraying a steel plate, a step of continuously forming the steel plate, a step of continuously welding the steel plate formed into a tubular shape at the joint of lengthwise end faces to form a steel tube, a step of continuously molten plating the external surface of the steel tube and a step of continuously thermal spraying the external surface of the steel tube.

The present invention may be represented in a more functional manner as follows. Specifically, the present invention relates to a process for producing a metal tube comprising continuously forming a metal plate composed of a first component into a tubular shape and continuously welding its butted ends to form the metal tube, wherein, prior to the continuous welding, a metal layer composed of a second component which is different from the first component is formed by thermal spraying over at least one surface of the metal plate, the metal layer having no discontinuities in the circumferential and lengthwise directions.

Also, the present invention relates to the process for producing a metal tube, wherein, after the continuous welding, the metal layer composed of a second component which is different from the first component is formed by thermal spraying directly over the surface of the metal tube, the metal layer having no discontinuities in the circumferential and lengthwise directions.

Also, the present invention relates to the process for producing a metal tube, wherein, after the continuous welding, the metal layer having no discontinuities in the circumferential and lengthwise directions is formed by thermal spraying through a metal layer composed of a component which is different from the first component over the surface of the metal tube.

According to the present invention, formation of the metal layer by thermal spraying is performed preferably to the internal surface prior to the continuous welding and to the surface of the tube after the continuous welding and may also be performed in combination.

According to the process of the present invention, a metal tube comprising a first metal tube portion composed of a first component, the first metal tube portion having a lengthwise continuous molten bonded section on at least part of the cross section of the first metal tube portion, and a second metal layer formed directly or through a metal layer composed of a component which is different from the first component over any of the surfaces of the first metal tube portion, the second metal layer being formed by thermal spraying continuously in the direction of the cross section can be produced.

Further, the present invention may be characterized that sufficient bonding strength with the metal layer composing the plated layer is provided by performing thermal spraying when the surface of the plated layer is not completely cooled or, preferably, is semi-molten. The term "semi-molten" means a condition midway toward coagulation at a temperature from the melting point to about 80% of the melting point, for example, from the melting point to 400° C. in case of zinc as a plated layer.

The plated layer for the metal tube obtained by the present invention is characterized that the metal having a second component is scattered in the shape of islands in the metal having a first component and that the metal having the second component is distributed in a layered manner in the metal having the first component.

A metal to be used for thermal spraying and molten metal plating may preferably be zinc, but it may also be an alloy containing aluminum or other metals in addition to zinc or may be another metal such as tin.

The term "thermal spraying" as used herein is in accordance with general definitions based on well-known metallurgical technology. As one of such definitions, the term refers to a process for heating a material to be thermal sprayed using combustion or electrical energy and blowing particles rendered molten or substantially molten to a substrate to form a coated film (refer to JIS Handbook: Metal Surface Treatment 118200).

According to the present invention, a metal layer is formed over the internal or external surface of a metal tube by thermal spraying, instead of a conventional plating step, such as molten plating, with a result that highly expensive installation and maintenance of plated layers may be dispensed with, a wide variety of metal layers may be formed with low-cost initial investment and the degree of freedom for designing metal tubes may be increased.

According to the present invention, in contrast to conventional local restoration of a metal tube by thermal spraying, a metal layer that is continuous in the cross sectional or circumferential direction, such as the whole surface of a metal tube, is formed by thermal spraying. Use of thermal spraying that is not intended for local restoration is not familiar with those skilled in the art.

According to the present invention, a thermal sprayed, metal plated steel tube that is excellent in corrosion resistance and effective in rust prevention may be obtained by forming an aluminum layer and an alloy metal containing aluminum in zinc plating using a thermal spraying device.

According to the present invention, positional relationship between a substrate metal and a thermal sprayed metal (distribution relationship) may be controlled when a plated layer is composed of an alloy containing multiple metals or compositions.

The effects and other features of the present invention as described herein shall not be construed as limiting the scope of rights of the present invention. It is needless to say that embodiments comprising some, but not all, of such effects and features may also fall within the scope of rights of the present invention on the basis of interpretation of rights established in national laws and practices.

DETAILED DESCRIPTION OF THE INVENTION

An embodiment of the present invention will be described below in detail.

Figure 1:
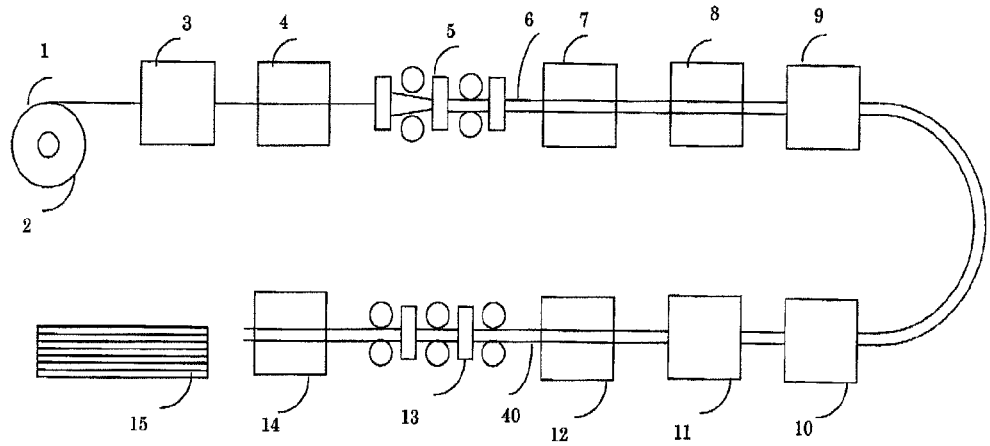
FIG. 1 is a schematic diagram of a production line according to one embodiment of the present invention.

A process for producing a thermal sprayed, metal plated steel tube according to the embodiment comprises a production line as shown in FIG. 1. The production line includes, at least, an uncoiler 2 for feeding a continuous steel plate wound around a coil 1, a forming device 5 for continuously forming the steel plate fed from the uncoiler 2 into a tubular shape, an internal surface thermal spraying device 4 for thermal spraying the steel plate with a desired metal immediately before continuously forming the steel plate into a tubular shape, a welding device 7 for welding the joint of lengthwise end faces of the plated steel plate formed into a tubular shape to form a tubular body, a cutting device 8 for continuously cutting weld beads formed on the external surface of the tubular body, and a molten zinc plating device 11 for continuously molten zinc plating the external surface of the tubular body to form a molten zinc plated steel tube.

It is also possible to eliminate the internal surface thermal spraying device 4 from the above arrangement and to provide instead an external surface thermal spraying device 12 for thermal spraying, subsequent to the molten zinc plating device 11, if necessary.

It is also possible to provide the internal surface thermal spraying device 4 in conjunction with the external surface thermal spraying device 12 along the production process. Such arrangement depends on the specifications of steel tubes to be produced.

If necessary, a flux application device 9 for continuously applying a liquid flux for cleansing and antioxidizing the external surface of the tubular body and a preheating device 10 for simultaneously drying the external surface of the tubular body and preheating the tubular body may also be provided. Also, a sizing device 13 for shaping the molten zinc plated steel tube thus produced into specified dimensions and a sectioning device 14 for sectioning the molten zinc plated steel tube in a predetermined length may be provided.

A process according to the present invention using the above production line will then be described.

First, a steel plate wound as a coil is continuously fed from the uncoiler 2 downstream along the line.

The steel plate fed is introduced into the forming device 5, being simultaneously thermal sprayed by the thermal spraying device 4, to be cold formed to be tubular. The thermal spraying should preferably be applied to one of the surfaces of the steel plate and the thermal sprayed surface should preferably be the internal surface of the formed tube. The thermal spraying may be performed before or after the start of forming. Subsequently, the joint of lengthwise end faces is continuously welded by the welding device 7 to form a single continuous tubular body 6.

The tubular body 6 is then fed to the cutting device 8 comprising an attached blade conformal to the contour of the tubular body 6. Weld beads formed on the external surface of the tubular body 6 are then scraped off by the blade of the cutting device 8 to smooth the external surface of the tubular body 6.

The tubular body is subsequently fed to the flux application device 9 to be applied with a liquid flux for cleansing and antioxidizing the external surface of the tubular body.

The tubular body 6 is fed to the preheating device 10 to be preheated while the external surface is dried.

Thereafter, the tubular body is fed to the molten zinc plating device 11, where the tubular body 6 is immersed in an upper plating bath that is filled with pumped-up molten zinc so that the whole external surface may be plated with the molten zinc. The tubular body 6 that has been immersed in the upper plating bath is provided with a molten zinc plated layer having a wholesome alloy layer and is now a molten zinc plated steel tube. Then, excess molten zinc plating is removed at a wiping device (not shown) and, then, a thermal sprayed, metal plated steel tube 40 is completed by the external surface thermal spraying device 12. Cooling is then carried out.

During this time, the thermal spraying by the external surface thermal spraying device 12 needs to be carried out before the surface temperature of the molten zinc plated layer drops to the ambient temperature. In general, a thermal sprayed metal layer formed over a cooled metal surface is uniformly formed along irregularities on the metal surface and thereby secures bonding strength only through the anchor effect by such irregularities. When thermal spraying is carried out in such conditions that the surface temperature of a molten zinc plated layer may not drop to the ambient temperature as in the present invention, however, part of the thermal sprayed metal may infiltrate into the molten zinc plated layer, or an alloy layer or an element diffusion layer may be formed between the molten zinc plated layer and the thermal sprayed layer, so that the bonding strength may be enhanced by other factors than the anchor effect.

According to the present invention, it is preferable to carry out thermal spraying in such conditions that the surface temperature of a molten zinc plated layer is higher than the ambient temperature. It is more preferable that the surface of a molten zinc plated layer is semi-molten. A semi-molten refers to a condition at temperatures ranging from a temperature of solid-liquid coexisting region to several tens of ° C. or, at most, 100° C. lower than the temperature of solid-liquid coexisting zone, when a metal layer of a plated layer is of a metal with a composition having such a solid-liquid coexisting region. When a pure metal composes such a plated layer, there is no such temperature of solid-liquid coexisting region. In this case too, however, substantially the same will hold true. Temperatures of a semi-molten condition preferable for the present invention may vary depending on the combination of a plated layer and a thermal sprayed metal layer. In general, any high temperatures capable of producing bonding strength through element diffusion and/or alloying between a plated layer and a thermal sprayed layer or other mechanisms than the anchor effect are applicable for the purpose of the present invention.

According to this embodiment, a metal layer by thermal spraying must be formed circumferentially all over the surface of a tube. As such, according to this embodiment, the external surface thermal spraying device is provided with three thermal spray nozzles 120° apart in direction from each other to carry out thermal spraying of a metal. A thermal sprayed metal layer can be formed with thermal spraying from two directions 180° apart from each other; however, thermal spray nozzles should desirably be provided in three or more directions to form a thermal sprayed metal layer.

The thermal sprayed, metal plated steel tube 40 is then cold rolled at the sizing device 13 in order to produce the external shape complying with specified dimensions. Cold rolling is a step necessary in this embodiment to form the thermal sprayed layer with a relatively even thickness in the circumferential direction. In other words, even when the thermal sprayed metal layer has unequal thickness in the circumferential direction immediately after being formed by the external surface thermal spraying device, subsequent cold rolling and the like can even out the thermal sprayed metal layer with a relatively uniform thickness. Thus, according to the preferred embodiment of the present invention, a step of sizing, such as cold rolling, a thermal sprayed metal layer after the formation of the thermal sprayed metal layer by the external surface thermal spraying device to provide the thermal sprayed metal layer with a relatively uniform thickness (a step of making the thickness distribution more uniform than that immediately after the formation of the thermal sprayed metal layer) may desirably be adopted.

The thermal sprayed, metal plated steel tube is sectioned by the sectioning device 14 in a predetermined length to be a steel tube product 15.

Figure 2:
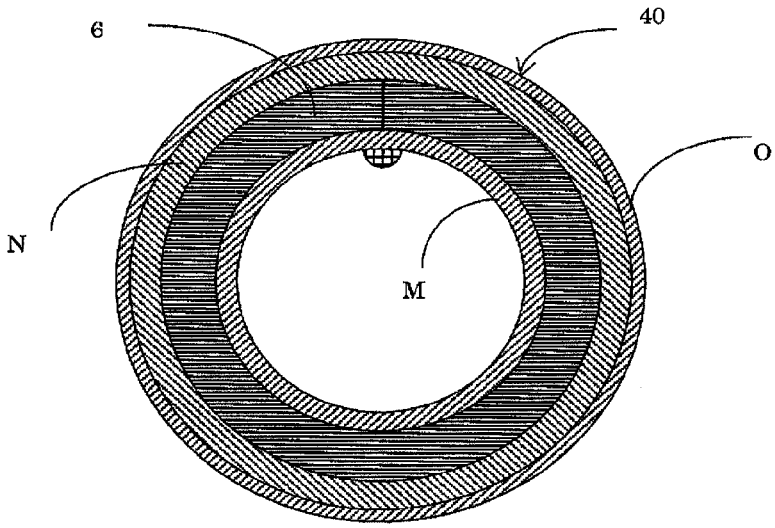
FIG. 2 is a longitudinal section of thermal sprayed metal plating produced by a process according to the embodiment.

According to the process for producing a thermal sprayed, metal plated steel tube as designed above, a thermal sprayed metal plated steel tube that is excellent in corrosion resistance and effective in rust prevention may continuously be obtained by providing the tubular body 6 having thereon a molten zinc plated layer with a thermal sprayed metal layer M over the internal surface and a thermal sprayed metal layer O over the external surface. In FIG. 2, the thermal sprayed metal layer O is formed externally around a zinc plated layer N.

The present invention is not limited to the above embodiment. For example, in the above embodiment, thermal sprayed metal layers are formed by a thermal spraying device over both the external and internal surfaces; however, a thermal sprayed metal layer may be provided by a thermal spraying device only over either one of the external and internal surfaces. In addition, when a thermal sprayed metal layer is provided only over the external surface, use of a double-side plated steel plate can produce a steel tube provided with a plated layer over the internal surface and a double metal layer (plated layer plus thermal sprayed metal layer) over the external surface. Furthermore, when a metal plated steel plate that has a plated layer over one side is used, a thermal sprayed metal layer may be formed over the other surface with no metal plating so that both the internal and external surfaces of a tube may have a metal layer to enhance the anti-corrosive effect.

Also, the top surface of the thermal sprayed metal layer may be coated with a protective film of a synthetic resin and the like. Thus, the rust preventive effect of the thermal sprayed, metal plated tube may further be enhanced.

Further in this embodiment, molten zinc is utilized as a plating to be applied to a steel tube; however, if necessary, other metals may also be utilized. Also in this embodiment, description was made with an assumption that a steel plate is used; however, the present invention may be premised on the use of other metal plates. Such metal plates include, but not limited to, copper tapes, aluminum tapes and the like.

The surface treatment process according to the present invention is applicable not only to metal tubes but also to any metal members. Such metal members would have metal surfaces produced by plating a metal surface with a molten metal having a first component to produce a first metal surface and thermal spraying the surface of the first metal layer with a metal having a second component to provide a surface layer in which the metals having the first and second components are blended together.

EXAMPLES

Working examples of processes for producing thermal sprayed, metal plated steel tubes will be illustrated below.

Example 1

Aluminum was used as a metal to be thermal sprayed. A rolled continuous steel plate with a thickness of 1.2 mm and a width of 59.5 mm was set in a production line as shown in FIG. 1 and was processed with shot blasting on the internal surface with a shotblast, followed by being applied with a thermal sprayed metal layer over the internal surface with a thermal spraying device. In addition, after a molten zinc plating device, aluminum was thermal sprayed with an external surface thermal spraying device.

According to the present invention, conditions such as temperatures of the surface of zinc at the time of thermal spraying (ordinary temperature to 450° C.), line speeds (0 to 400 m/min) and spraying angles (0 to 90°) can be combined as appropriate. Concurrently, the bonding concentrations and distribution of aluminum can be controlled by adjustment of the amounts of thermal sprayed aluminum.

Figure 5:
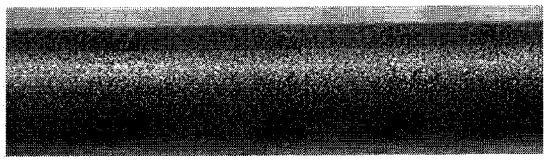
FIGS. 5*a*-5*c* show external appearances of metal tubes produced in Example 1.
Figure 5:
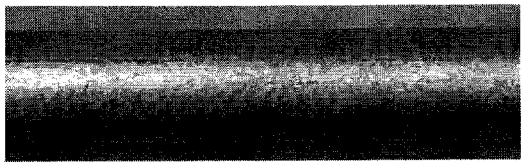
Figure 5:
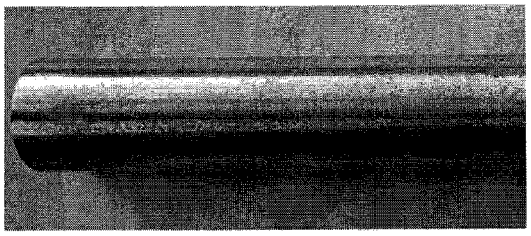

FIG. 5 shows in comparison appearances of a steel tube produced by Example 1 and a steel tube produced by a molten plating process as a prior art. According to the molten plating process as a prior art, the surface exhibits a pattern (spangle) reflecting its unique grain boundaries (FIG. 5 (*a*)) while the surface of the steel tube produced by the thermal spraying of Example 1 is coarsely granular (FIG. 5 (*b*)). Plated steel tubes exhibiting such coarse granular surfaces were not known at the time of filing of the present application and, therefore, it is assumed that the plated steel tube having such a surface has been produced by the process according to the present invention. In addition, there is shown an appearance of a steel tube produced by Example 1 which was polished with a sandpaper (FIG. 5 (*c*)). The sandpapered steel tube is metallically lustrous with punctiform recesses or pits that are unique to thermal spraying and, therefore, it is assumed that the tube having such an appearance has also been produced by the process according to the present invention.

Figure 3:
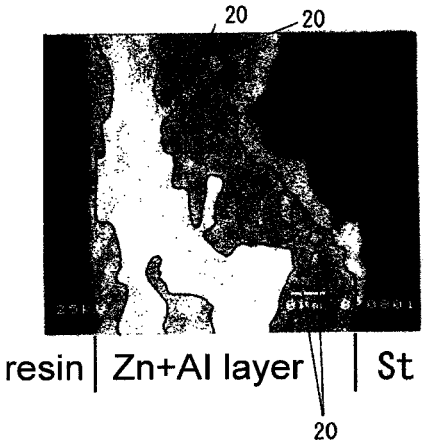
FIG. 3 shows a result of surface analysis of Al element over a surface-treated layer of a metal tube produced in this example.
Figure 4:
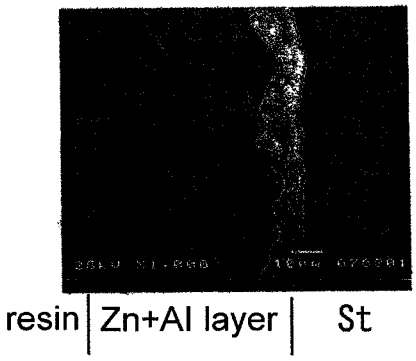
FIG. 4 shows a result of surface analysis of Al element over a surface-treated layer of a metal tube produced in this example.

FIG. 3 schematically shows the result of Al elemental analysis for the product produced in Example 1. As a result of elemental analysis on the thermal sprayed metal layer over the external surface, it is observed that the thermal sprayed metal (aluminum) is scattered in the shape of islands throughout the zinc layer, 20. Also, FIG. 4 shows the result of Al elemental analysis when thermal spraying was carried out under another set of conditions. Contrary to FIG. 3, Al is segregated in the vicinity of the steel wire (St) and distributed in a layered manner in the vicinity of the steel wire in a location that is different from Zn and is farther as seen along the direction of thermal spraying. Thus, the plated layer produced by the process according to the present invention is characterized for one thing by that a thermal sprayed metal is scattered in the shape of islands and/or is distributed in a layered manner in a substrate metal. In addition, in Example 1, it is apparent that the plated layer and the thermal sprayed layer are not bonded only through the anchor effect.

Such distribution in the shape of islands or in a layered manner is one of the characteristics when the process according to the present invention is used; however, such a characteristic may disappear when heat treatment or the like is applied after the process according to the present invention was applied. It may be assumed that the plated layer having such a characteristic was produced by the process according to the present invention.

Inferring details of the principle for such distribution, the process according to the present invention adopts thermal spraying in which a metal that is different from a plated substrate metal is sprayed through physical force, in contrast to conventional molten plating in multiple times and, therefore, distribution between the plated substrate metal and the thermal sprayed metal is influenced at least by the temperature of the plated substrate metal at the time of thermal spraying (which influences the hardness of the surface and the like), the temperature of the thermal sprayed metal at the time of thermal spraying (which influences the hardness of the thermal sprayed metal) and the rate at which the thermal sprayed metal reaches the plated substrate metal (kinetic energy). Based on these factors, distribution as shown in FIG. 3 is formed under the conditions where the thermal sprayed metal convects in the relative vicinity of the surface. On the other hand, distribution as shown in FIG. 4 may be formed under the conditions where the thermal sprayed metal reaches the vicinity of the surface of the steel wire (St).

Example 2

Aluminum was used as a metal to be thermal sprayed, and a rolled continuous steel plate with a thickness of 1.2 mm and a width of 59.5 mm was set in a production line as shown in FIG. 1 and was processed with shot blasting on the internal surface with a shotblast device, followed by being applied with a thermal sprayed metal layer over the internal surface with a thermal spraying device. In addition, after molten zinc plating, aluminum was thermal sprayed with an external surface thermal spraying device.

Figure 6:
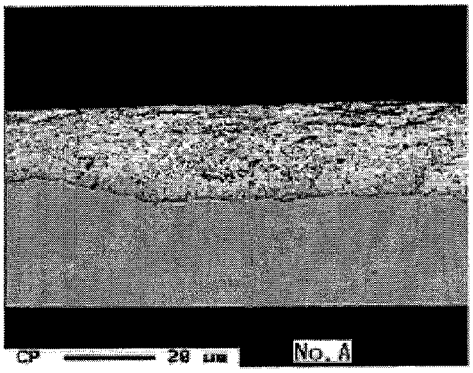
FIGS. 6*a*, 6*b* show results of line analysis of a surface-treated layer of a metal tube produced in Example 2.
Figure 6:
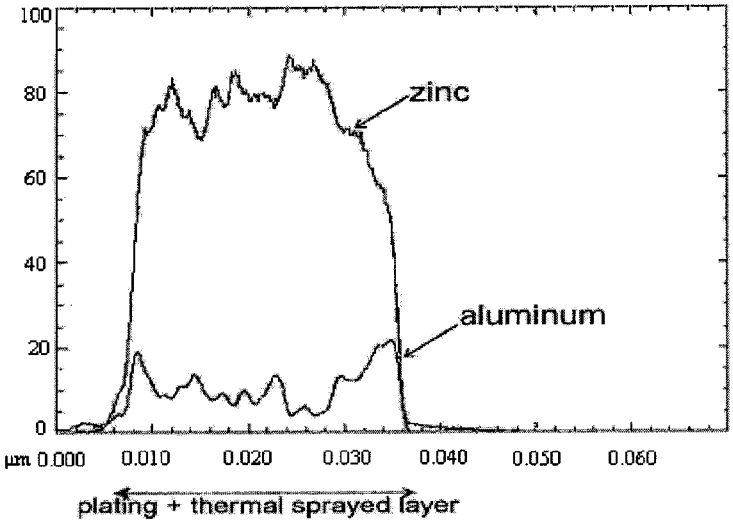

A photograph of the appearance of the obtained section is shown in FIG. 6 (*a*) and the elemental analysis of the section as determined by EPMA is shown in the chart of FIG. 6 (*b*). As shown in FIG. 6 (*a*), characteristic scattering of the thermal sprayed metal in the shape of tiny islands throughout the substrate metal is observed also in this example. It is seen that tiny dots of blackish aluminum are scattered throughout the whitish zinc substrate. In addition, as shown in FIG. 6 (*b*), the zinc and aluminum are distributed in relatively uniform concentrations in the steel tube produced in this example.

Example 3

Aluminum was used as a metal to be thermal sprayed, and a rolled continuous steel plate with a thickness of 1.2 mm and a width of 59.5 mm was set in a production line as shown in FIG. 1 and was processed with shot blasting on the internal surface with a shotblast, followed by being applied with a thermal sprayed metal layer over the internal surface with a thermal spraying device. In addition, after a molten zinc plating device, aluminum was thermal sprayed with an external surface thermal spraying device. In this example, aluminum was thermal sprayed at 15 g/min with a surface temperature of the zinc plating of 400° C. during a low production rate of 20 m/min with a spraying angle of 90°. Contact between the zinc and the thermal sprayed aluminum fuses to promote bonding with the aluminum so that distribution of an aluminum layer at the surface, a zinc-aluminum layer in-between and a zinc layer at the innermost layer may be obtained. This arrangement is feasible at a medium to high production rate depending on a series of correlationship between line speeds, surface temperatures of zinc plating, amounts of sprayed aluminum, and the like.

Figure 7:
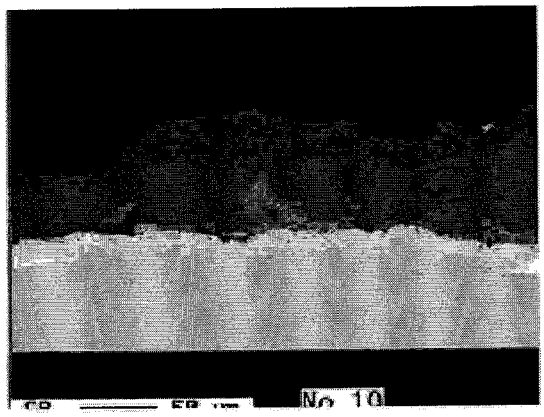
FIGS. 7*a*, 7*b* show results of line analysis of a surface-treated layer of a metal tube produced in Example 3.
Figure 7:
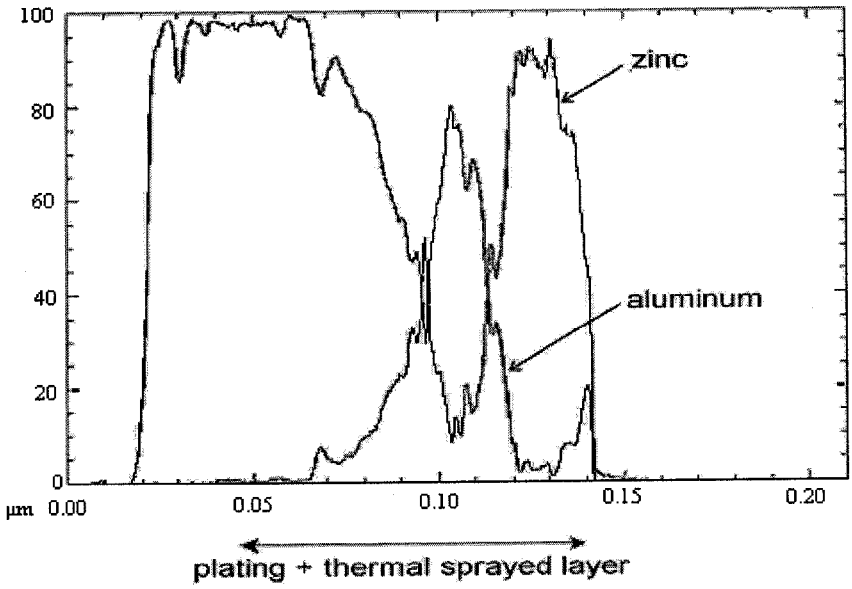

The obtained section is shown in FIG. 7 (*a*) and the elemental analysis of the section as determined by EPMA is shown in the chart of FIG. 7 (*b*). As shown in FIG. 7 (*a*), according to the present invention, aluminum (blackish part) is eccentrically located at the surface and zinc (whitish part) is located at the interface with the steel core. Examined more closely by elemental analysis, the distribution exhibits an substantially pure aluminum layer formed at the surface and a gradual reversal in the concentrations of the aluminum and zinc, as shown in FIG. 7. Reasons for such element distribution are not clear; however, it may presumably be due to the change in depth of infiltration of the aluminum into the zinc as a thermal sprayed metal layer, depending on the fusing temperature of the aluminum at the time of thermal spraying, the temperature of the zinc as a thermal sprayed metal layer and the initial velocity (kinetic energy) of the thermal sprayed metal particles, This suggests the possibility of arbitrarily controlling the element distribution in a metal layer by adjustment in such parameters.

The product of this embodiment is composed of an aluminum layer with a purity of almost 100% down to a depth of 50 μm from the surface and an alloy layer of aluminum and zinc in the deeper section. In general, since pure aluminum is highly corrosion resistant, a product with such element distribution is more corrosion resistant as a plated steel tube. The increased corrosion resistance is partly attributable to that even if minute defects (pinholes) exist in the aluminum layer, the zinc layer will provide a sacrificial corrosion preventive action, bearing an anti-corrosive function through a mechanism of action that is different from that of aluminum. According to the present invention, a product having a pure aluminum layer at the surface and an alloy layer of aluminum and zinc or a zinc layer in the interior may be obtained. In such cases, the pure aluminum layer has a thickness of 30% or more, preferably 50% or more, of the thickness of the whole plated layer. The aluminum layer at the surface does not necessarily have to be an aluminum layer with a purity of 100% as long as it has corrosion resistance that is substantially equal to that of 100% aluminum. From this point of view, inclusion of other elements such as zinc in the order of 1 to 5% is tolerable.

This shows that it is possible to control not only the composition but also the metal distribution of a plated layer by adopting the process according to the present invention.

Although description was made herein by way of example using zinc as a metal to be used for molten metal plating, it is not limited thereto. For example, an alloy containing aluminum or other metals in addition to zinc or another metal such as tin may also be used. In addition, although description was made herein by way of example using aluminum as a metal to be thermal sprayed, it is not limited thereto. For example, zinc, magnesium or other metals may also be used. The present invention comprises an invention relating to a process for production and, at least in an invention relating to a process for production, the identity of metals or alloys may not matter.

The invention claimed is:

1. A process for producing a metal tube comprising continuously forming a metal plate into a tubular shape and continuously welding its butted ends to form a metal tube base, and prior to the continuous welding, forming a metal plating layer on the metal plate by immersing the metal plate in a plating bath where a metal of the metal plating layer is present in a molten state, followed by thermal spraying a metal over a surface of the metal plating layer, wherein the thermal spraying is carried out with the surface of the metal plating layer being semi-molten.

2. The process according to claim 1, wherein the metal plate is steel.

3. The process according to claim 1, wherein the metal of the metal plating layer is zinc.

4. The process according to claim 1, the metal of the thermal spraying is aluminum.

5. The process according to claim 1, wherein the metal tube base is steel and the metal of the metal plating layer is zinc.

6. The process according to claim 1, wherein the metal of the metal plating layer is zinc and the metal of the thermal spraying is aluminum.

7. The process according to claim 1, wherein the metal plate is steel, the metal of the metal plating layer is zinc, and the metal of the thermal spraying is aluminum.

8. A process for producing a metal tube comprising continuously forming a metal plate into a tubular shape, continuously welding its butted ends to form a metal tube base, forming a metal plating layer after the continuous welding on the metal tube base by immersing the metal tube base in a plating bath where a metal of the metal plating layer is present in a molten state, followed by thermal spraying a metal over a surface of the metal plating layer, wherein the thermal spraying is carried out with the surface of the metal plating layer being semi-molten.

9. The process according to claim 8, wherein the metal tube base is steel.

10. The process according to claim 8, wherein the metal of the metal plating layer is zinc.

11. The process according to claim 8, wherein the metal of the thermal spraying is aluminum.

12. The process according to claim 8, wherein the metal tube base is steel and the metal of the metal plating layer is zinc.

13. The process according to claim 8, wherein the metal of the metal plating layer is zinc and the metal of the thermal spraying is aluminum.

14. The process according to claim 8, wherein the metal tube base is steel, the metal of the metal plating layer is zinc, and the metal of the thermal spraying is aluminum.

* * * * *